US008567903B2

(12) United States Patent
Nishida

(10) Patent No.: US 8,567,903 B2
(45) Date of Patent: Oct. 29, 2013

(54) LIQUID DROPLET JETTING APPARATUS

(75) Inventor: Katsunori Nishida, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/354,515

(22) Filed: Jan. 20, 2012

(65) Prior Publication Data

US 2012/0194611 A1 Aug. 2, 2012

(30) Foreign Application Priority Data

Jan. 31, 2011 (JP) ..... 2011-017569

(51) Int. Cl.
*B41J 2/165* (2006.01)

(52) U.S. Cl.
USPC ..... 347/36

(58) Field of Classification Search
None
See application file for complete search history.

(56) References Cited

U.S. PATENT DOCUMENTS 4,965,596 A * 10/1990 Nagoshi et al. ..... 347/36
6,252,615 B1 * 6/2001 Yoshino ..... 347/36

FOREIGN PATENT DOCUMENTS

| | | |
|---|---|---|
| JP | 3-084143 | 8/1991 |
| JP | 4235055 | 8/1992 |
| JP | 8104014 | 4/1996 |
| JP | 2004-249597 | 9/2004 |

* cited by examiner

*Primary Examiner* — Matthew Luu
*Assistant Examiner* — Alejando Valencia
(74) *Attorney, Agent, or Firm* — Frommer Lawrence & Haug LLP

(57) ABSTRACT

A liquid droplet jetting apparatus includes a liquid droplet jetting head which jets droplets of two types of liquids; a discharge mechanism which discharges the two types of liquids from the jetting head respectively; a waste liquid recovery device which recovers the two types of liquids discharged by the discharge mechanism, having a waste liquid case, an absorbing body accommodated in the waste liquid case, two liquid intake portions for letting the two types of liquids discharged by the discharge mechanism flow respectively into the waste liquid case, and a waste liquid detection section which detects whether only one or both of the two types of liquids has or have reached a detection position by measuring electric conductivity at the detection position away from the two liquid intake portions in the absorbing body; and a full liquid judging section which judges whether the absorbing body is fully permeated.

9 Claims, 9 Drawing Sheets

LIQUID DROPLET JETTING APPARATUS

CROSS REFERENCE TO RELATED APPLICATION

The present application claims priority from Japanese Patent Application No. 2011-017569, filed on Jan. 31, 2011, the disclosure of which is incorporated herein by reference in its entirety.

BACKGROUND OF THE INVENTION

1. Field of the Invention

The present invention relates to liquid droplet jetting apparatuses for jetting liquid droplets.

2. Description of the Related Art

In conventional liquid droplet jetting apparatuses for jetting liquid droplets, there are many liquid droplet jetting apparatuses each of which is provided with a waste liquid recovery device recovering an unnecessary liquid (hereinafter referred to also as "waste liquid") discharged for example during maintenance for the liquid droplet jetting head. Each of the waste liquid recovery devices of general type has a waste liquid case and an absorber (absorbing member) which is formed of a porous material, which is accommodated in the waste liquid case and which absorbs the waste liquid.

Among them, Japanese Patent Application Laid-Open No. 08-104014 discloses an ink jet recording apparatus including a means (a full liquid detection means) for detecting a full liquid state of the absorber. In more detail, it is configured such that the absorber (ink absorbing member) is accommodated in the waste liquid case (waste ink recovering container), and that a pair of electrodes are provided to the waste liquid case at a portion (where ink reaches last) away from a portion from which waste liquid flows into the waste liquid case (liquid intake portion). The full liquid state is detected by detecting conduction between the electrodes when the waste liquid has reached the portion at which the pair of electrodes are provided.

However, when the liquid droplet jetting apparatus uses two or more types of liquids, in order to prevent mixture of different types of liquids, etc., it is sometimes configured not to send two types of waste liquids collectively to the waste liquid case, but to send them through different routes to the waste liquid case, respectively. In this case, these two types of waste liquids permeate respectively into different parts of the absorber from two liquid intake portions provided respectively in the waste liquid case.

According to the above configuration, when adopting the method for detecting a full liquid state of the absorber with electrodes provided in the absorber at a predetermined detection position as in the ink jet recording apparatus disclosed in the Japanese Patent Application Laid-Open No. 08-104014, the two types of waste liquids scarcely reach the detection position at the same time, but usually reach there one after the other. In such cases, even if the absorber is determined to be fully permeated as only one liquid has reached the detection position, since the other liquid has not yet actually reached there, there is still room in the absorber (portions having not yet absorbed liquids). That is, although the absorber can actually absorb more waste liquids, it is falsely determined to be fully permeated, thereby decreasing the efficiency of absorbing waste liquids.

SUMMARY OF THE INVENTION

An object of the present invention is to improve the efficiency of absorbing waste liquids by accurately detecting absorber's full liquid permeation state in the configuration in which two types of liquids different in electric conductivity flow into the waste liquid case respectively from different liquid intake portions.

According to an aspect of the present teaching, there is provided a liquid droplet jetting apparatus which jets droplets of two types of liquids different in electric conductivity, the apparatus including: a liquid droplet jetting head which jets the droplets of the two types of liquids, respectively; a discharge mechanism which discharges the two types of liquids from the liquid droplet jetting head, respectively; a waste liquid recovery device which recovers the two types of liquids discharged by the discharge mechanism, the waste liquid recovery device including: a waste liquid case, an absorbing body accommodated in the waste liquid case, two liquid intake portions through which the two types of liquids discharged by the discharge mechanism flow respectively into the waste liquid case, and a waste liquid detection section which measures an electric conductivity in the absorbing body at a detection position away from the two liquid intake portions by predetermined distances respectively, and which distinctively detects whether only one of the two types of liquids arrives at the detection position or both of the two types of liquids arrive at the detection position; and a full liquid judging section which judges that the absorbing body is in a full liquid state under a condition that the waste liquid detection section detects that both of the two types of liquids arrive at the detection position in the absorbing body.

The liquid droplet jetting apparatus is premised on the utilization of two types of liquids different in electric conductivity from each other. Then, these two types of liquids respectively discharged by the discharge mechanism from the liquid droplet jetting head are sent to the waste liquid recovery device, and absorbed into the absorber in the waste liquid case from two liquid intake portions. As the (waste) liquids flowing into the waste liquid case increase in quantity, some of them reach the detection position away from the two liquid intake portions respectively by a predetermined distance.

At this stage, the waste liquid detection section distinctively detects whether any one or both of the two types of liquids has or have reached the detection position from the electric conductivity at the detection position in the absorber. If only one of the two types of liquids has reached the detection position but the other has not, then it is conceivable that the absorber still has room (ink-unabsorbed portion) capable of absorbing more liquids. Hence, a full liquid state is determined as the waste liquid detection section detects that both of the two types of liquids have reached the detection position. By virtue of this, at the time of determining the full liquid permeation state, the absorber hardly has any ink-unabsorbed portion. Thus, it is possible to accurately determine the full liquid permeation state, thereby improving the efficiency of the absorber in absorbing the waste liquids. Further, the "full liquid state" of the present teaching not only refers to a limit state such as overflow may occur any time even if just a little waste liquid flows in any more, but also is a concept including states approaching the limit state such as attention should be called in advance through cautions and the like because little room is left before reaching the above limit state and thus disregarding the situation may bring on the limit state in a short time.

DESCRIPTION OF THE PREFERRED EMBODIMENT

Figure 1:
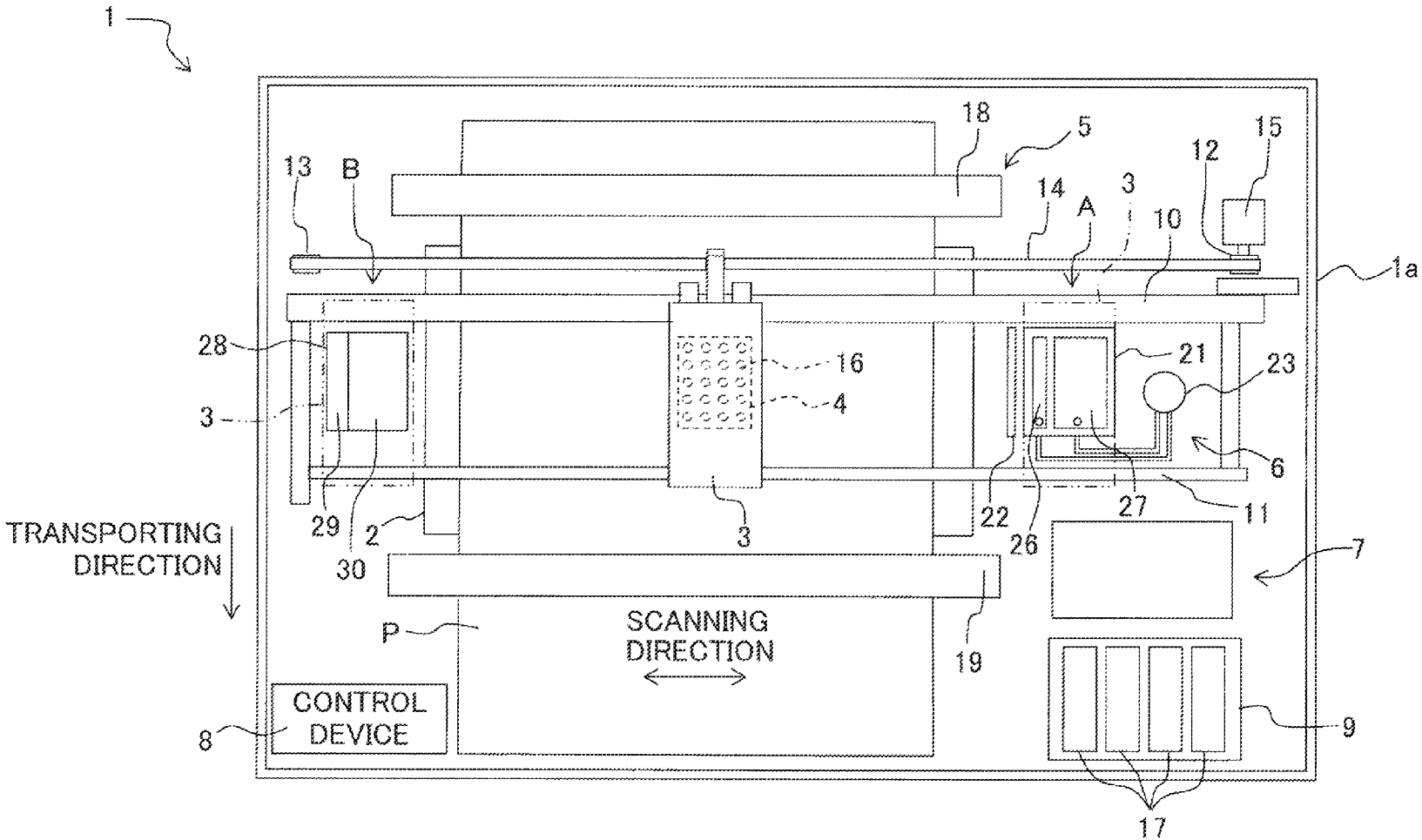
FIG. 1 is a schematic configuration diagram of an ink jet printer according to an embodiment of the present teaching.

Hereinbelow, a preferred embodiment of the present invention will be explained. FIG. 1 is a schematic configuration diagram of an ink jet printer in accordance with the preferred embodiment.

As shown in FIG. 1, an ink jet printer 1 (a liquid droplet jetting apparatus) includes a platen 2 for carrying a sheet of recording paper P thereon, a carriage 3 reciprocatingly movable in a scanning direction parallel to the platen 2, an ink jet head 4 (a liquid droplet jetting head) installed on the carriage 3, a transport mechanism 5 for transporting the recording paper P in a transporting direction perpendicular to the scanning direction, a maintenance unit 6 for carrying out various maintenance operations to recover and maintain liquid droplet jetting performance of the ink jet head 4, a waste ink recovery device 7 (a waste liquid recovery device) for collecting waste ink discharged from the ink jet head 4 in maintenance and the like, and a controller 8 for governing the overall control of the ink jet printer 1.

The recording paper P supplied from an unshown paper feeder is carried on the upper surface of the platen 2. Further, above the platen 2, two guide rails 10 and 11 are provided to extend parallel to the horizontal direction in FIG. 1 (the scanning direction), and the carriage 3 is configured to be reciprocatingly movable in the scanning direction along the two guide rails 10 and 11 in the region overlapping the platen 2. Further, the two guide rails 10 and 11 extend as far as to positions away from the platen 2 along the scanning direction both on the left and on the right in FIG. 1, and the carriage 3 is configured to be movable from the region overlapping the recording paper P on the platen 2 (the recording region) to the non-recording regions, i.e., the positions away from the platen 2 in the leftward and rightward directions. Further, the carriage 3 is coupled with an endless belt 14 stretched between two pulleys 12 and 13 and, when a carriage drive motor 15 drives the endless belt 14 to travel, the carriage 3 moves in the scanning direction along with the traveling of the endless belt 14.

The ink jet head 4 is installed below the carriage 3, and its lower surface parallel to the upper surface of the platen 2 is an ink jet surface with a plurality of nozzles 16 opening therein. Further, as shown in FIG. 1, a holder 9 is provided fixedly in a printer body 1*a* of the ink jet printer 1, and four ink cartridges 17 are installed in the holder 9 to retain inks of four colors (black, yellow, cyan, and magenta), respectively. Further, among the four-color inks utilized in the ink jet printer 1 of the embodiment, the black ink is a pigment ink (a second liquid) utilizing a color material insoluble in ink solvents such as water and the like, while the other three-color inks (to be collectively referred to as the color inks) are dye inks (a first liquid) utilizing color materials soluble in ink solvents. Further, illustration being omitted, the ink jet head 4 installed on the carriage 3 is connected to the holder 9 through four tubes (not shown), and the inks in the four ink cartridges 17 are supplied to the ink jet head 4 through these four tubes, respectively.

As shown in FIG. 1, the plurality of nozzles 16 of the ink jet head 4 form four nozzle rows in respective correspondence with the four-color inks. Further, the ink jet head 4 includes an actuator for causing ink droplets to be jetted individually from each of the plurality of nozzles 16 by applying a pressure to the inks in the plurality of nozzles 16, respectively. This actuator is not limited to a specific configuration but allowed to utilize publicly known products such as piezoelectric actuators making use of piezoelectric strain of piezoelectric elements, etc. Then, by virtue of the actuator, the ink jet head 4 jets the inks of the corresponding colors to the recording paper P carried on the platen 2 from the plurality of nozzles 16, respectively.

The transport mechanism 5 has two transport rollers 18 and 19 arranged to locate the platen 2 therebetween in the transporting direction and, by these two transport rollers 18 and 19, the recording paper P carried on the platen 2 is transported in the transporting direction (downward in FIG. 1).

Then, the ink jet printer 1 prints desired images, characters and the like on the recording paper P by jetting the inks from the ink jet head 4 reciprocatingly moving along with the carriage 3 in the scanning direction (the horizontal direction in FIG. 1) to the recording paper P carried on the platen 2, while transporting the recording paper P in the transporting direction (downward in FIG. 1) with the two transport rollers 18 and 19.

The maintenance unit 6 is arranged in a position (a maintenance position: the position A where the carriage 3 is indicated with a chain double-dashed line in FIG. 1) away from the platen 2 on one side in the scanning direction (on the right in FIG. 1). This maintenance unit 6 includes a cap member 21 for tightly contacting the lower surface of the ink jet head 4 (the ink jet surface) to cover the openings of the plurality of nozzles 16, a suction pump 23 connected to the cap member 21, a wiper 22 for wiping off the ink adhering to the ink jet surface 4*a* after suction purge, and the like.

Figure 5:
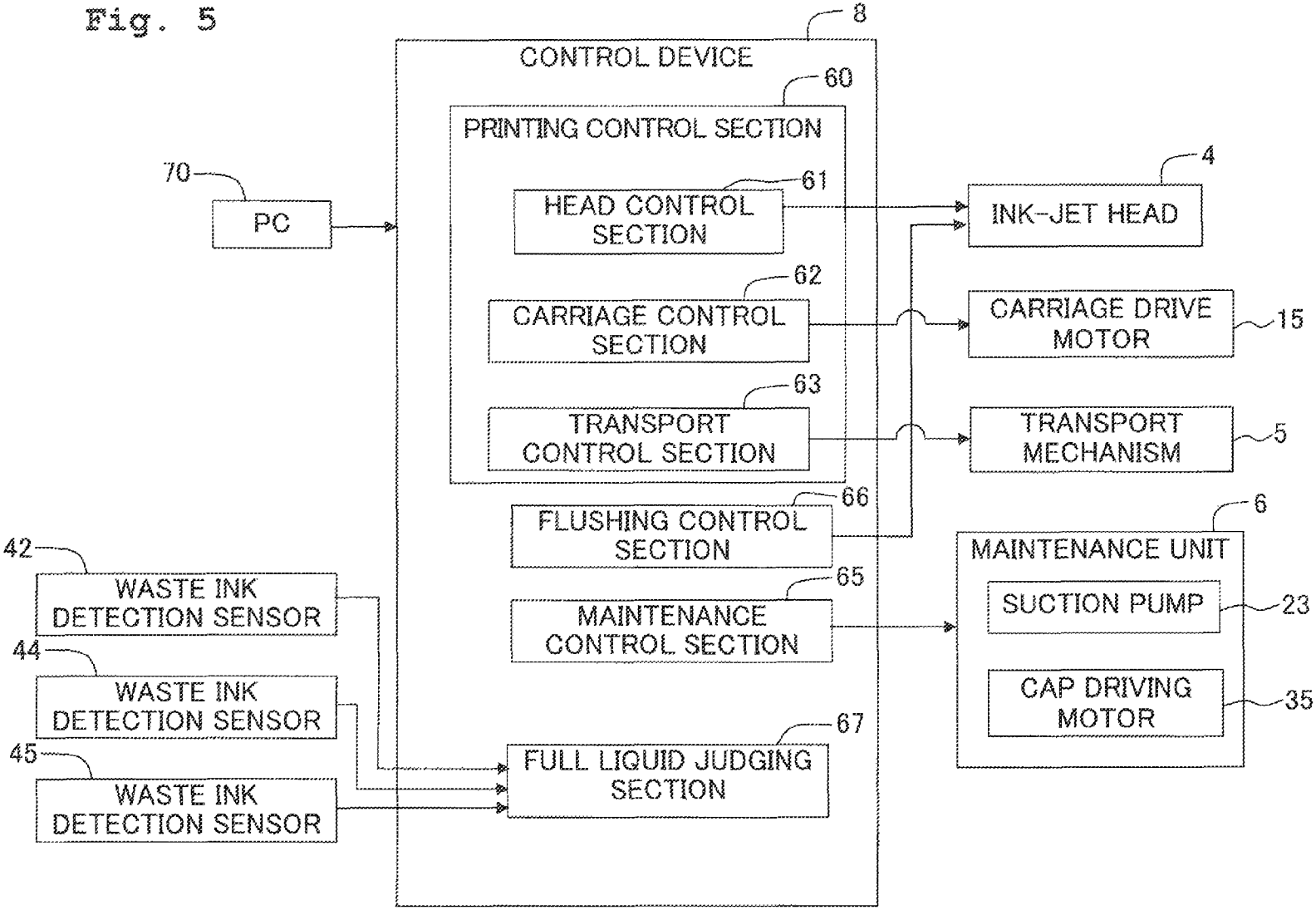
FIG. 5 is a block diagram schematically showing a control system of the ink jet printer.

The cap member 21 is configured to be movable in upward and downward directions (perpendicular to the plane of the paper of FIG. 1), and is driven to contact and leave the ink jet surface of the ink jet head 4 by a proper cap drive mechanism including a cap drive motor 35 (see FIG. 5). Further, the cap member 21 has a first cap portion 26 to cover the nozzles 16 (the first nozzle row on the left) for jetting the black ink, and a second cap portion 27 to cover the nozzles 16 (the three nozzle rows on the right) for jetting the three color inks (yellow, cyan and magenta), when the cap member 21 comes in the state of tightly contacting the ink jet surface of the ink jet head 4 (the capping state).

The first cap portion 26 and the second cap portion 27 are connected to the suction pump 23 through respective tubes. Further, when the cap member 21 is in the capping state, the suction pump 23 is capable of sucking (depressurizing) the inside of the first cap portion 26 and sucking (depressurizing) the inside of the second cap portion 27, independently. That is, it carries out ink discharge (suction purge) from the nozzles 16 for the black ink and from the nozzles 16 for the color inks, separately.

The wiper 22 is provided to stand in a position closer to the platen 2 than the cap member 21. After suction purge, the wiper 22 wipes off the ink adhering to the ink jet surface by letting the carriage 3 move in the scanning direction with the edge of the wiper 22 in a state of contacting the ink jet surface of the ink jet head 4.

Further, the ink jet printer 1 of the embodiment is configured to carry out a flushing to discharge inks by jetting the respective inks from the plurality of nozzles 16 of the ink jet head 4 at a proper time during the period that printing is not carried out on the recording paper P for the purpose of preventing the nozzles 16 from drying up internally, and the like. As shown in FIG. 1, a liquid receiving member 28 is provided in a position on the opposite side to the maintenance unit 6 across the platen 2 (a flushing position: the position B where the carriage 3 is indicated with another chain double-dashed line in FIG. 1). Then, the ink jet head 4 carries out the flushing with the carriage 3 having moved to the flushing position B, and the liquid receiving member 28 receives the inks discharged from the nozzles 16 due to the flushing. Further, in the same manner as the cap member 21, the liquid receiving member 28 is also divided into a first liquid receiving portion 29 for receiving the black ink in correspondence with the nozzle row jetting the black ink, and a second liquid receiving portion 30 receiving the color inks in correspondence with the three nozzle rows jetting the three color inks.

As described hereinbefore, in the embodiment, since a pigment ink is utilized as the black ink whereas dye inks are utilized as the other three color inks, it is known that if the pigment ink is mixed with the dye inks, then agglomeration occurs and becomes the cause of clogging ink flow passages, and the like. Therefore, the routes to the waste ink recovery device 7 are separate between black and color so that the waste inks discharged from the ink jet head 4 due to suction purge or flushing are not mixed in the course of being recovered into the waste ink recovery device 7.

Figure 2:
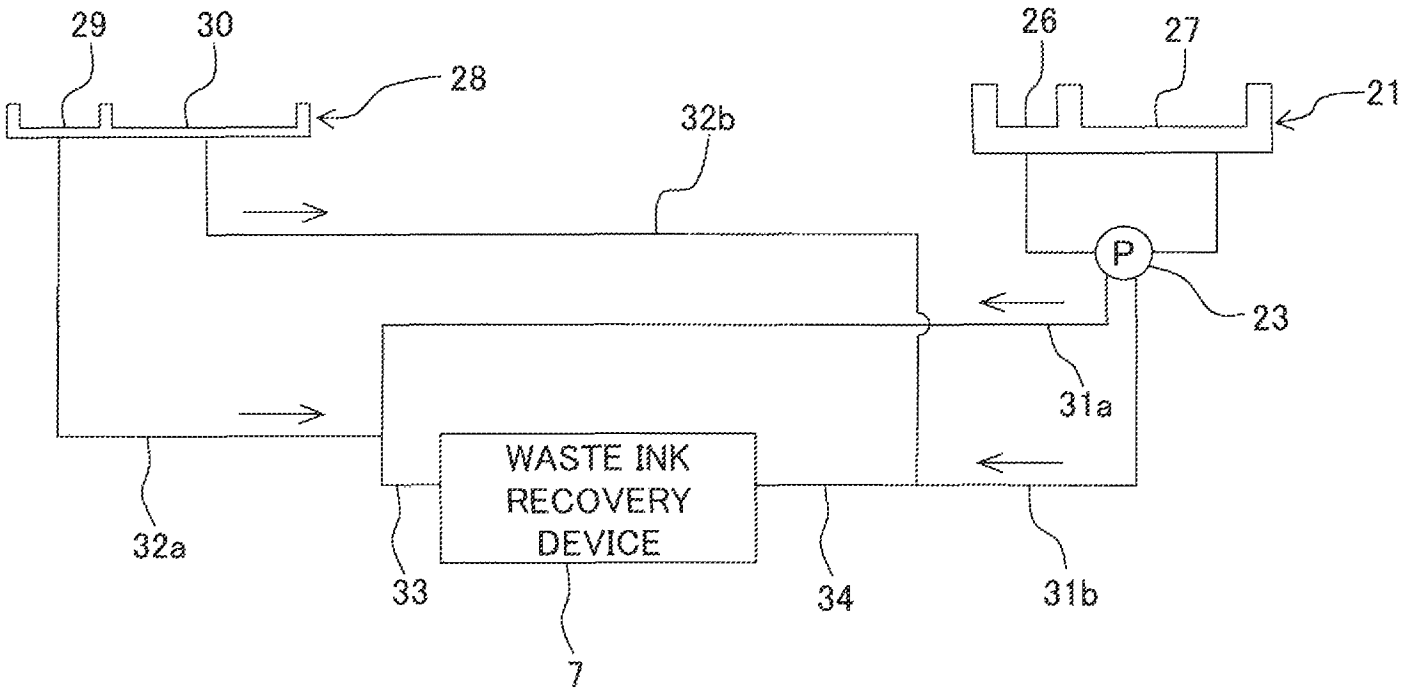
FIG. 2 schematically shows a connectional relation of a waste liquid recovery device with a cap member and a liquid receiving member.

FIG. 2 schematically shows a connectional relation of the waste ink recovery device 7 with the cap member 21 and the liquid receiving member 28. First, the suction pump 23 for carrying out suction purge is configured to prevent mixture of the black and color inks discharged into the cap member 21. For example, the first cap portion 26 and the second cap portion 27 may as well be connected to separate suction pumps 23, respectively. Alternatively, if the suction pump 23 is a tube pump, then tubes may be allotted to the first cap portion 26 and the second cap portion 27, separately.

The suction pump 23 is connected with the waste ink recovery device 7 through a tube 31*a* (and a tube 33) for the black ink, and a tube 31*b* (and a tube 34) for the color inks, separately. That is, the black waste ink and the color waste inks discharged into the cap member 21 are not sent to the waste ink recovery device 7 collectively, but sent to the waste ink recovery device 7 through separate routes respectively.

Further, with respect to the liquid receiving member 28 for flushing, too, the first liquid receiving portion 29 for the black ink and the second liquid receiving portion 30 for the color inks are also connected with the waste ink recovery device 7 through a tube 32*a* (and the tube 33) for the black ink, and a tube 32*b* (and the tube 34) for the color inks, separately. Thus, the black waste ink and the color waste inks are sent to the waste ink recovery device 7 through separate routes, respectively.

Next, the waste ink recovery device 7 will be explained. The waste ink recovery device 7 serves to recover the waste inks discharged from the nozzles 16 of the ink jet head 4 in the aforementioned suction purge or flushing. Further, the "discharge mechanism" of the present teaching corresponds to both the suction pump 23 for carrying out suction purge and the actuator of the ink jet head 4 operating to carry out the flushing.

Figure 3A:
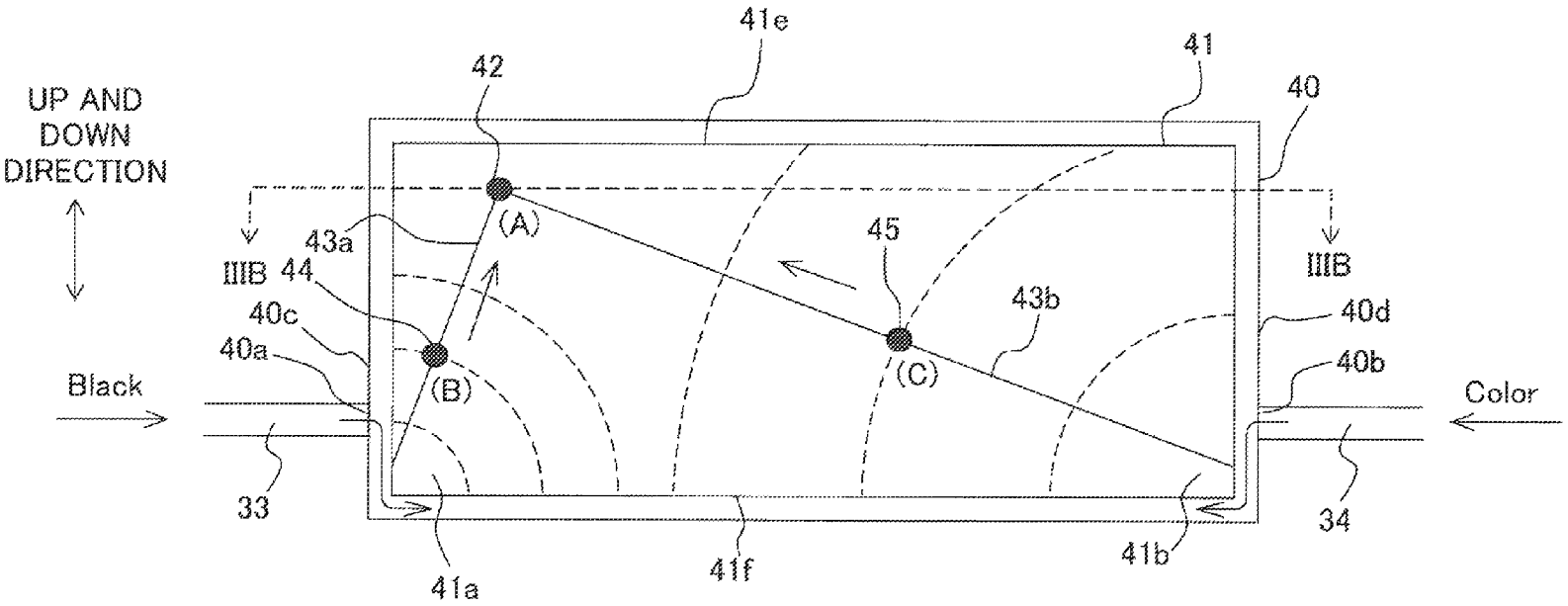
FIG. 3A is a schematic configuration diagram of a waste ink recovery device.

FIG. 3A is a schematic configuration diagram of the waste ink recovery device 7. As shown in FIG. 3A, the waste ink recovery device 7 has a waste ink case 40 (a waste liquid case) for waste ink to flow thereinto, an absorber 41 (absorbing body) accommodated in the waste ink case 40, and a waste ink detection sensor 42 (a waste liquid detection section) for detecting whether or not the waste ink flowing into the waste ink case 40 has reached a predetermined full liquid detection position (a detection position A) in the absorber 41.

Figure 3B:
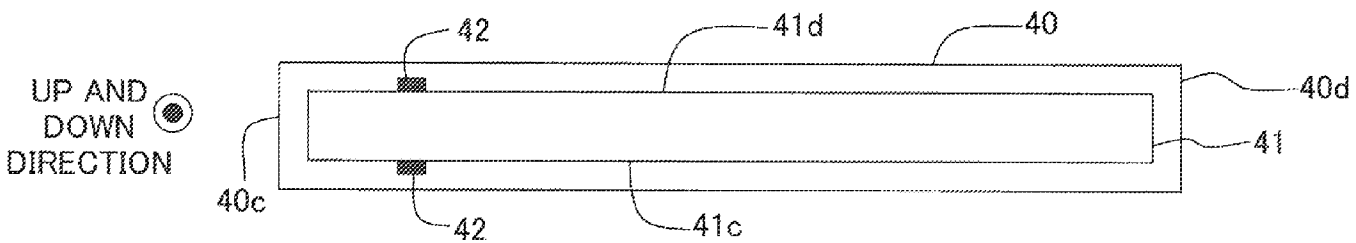
FIG. 3B is a cross-sectional diagram along the line IIIB-IIIB of FIG. 3A.

The waste ink case 40 is formed into a box-like rectangular parallelepiped, and provided with two waste ink intakes 40*a* and 40*b* (liquid intake portions) in two opposite lateral sides 40*c* and 40*d* of the waste ink case 40 for taking in the waste inks, respectively. Between the two waste ink intakes 40*a* and 40*b*, one waste ink intake 40*a* (a second intake on the left in FIGS. 3A and 3B) is connected to the tube 33 (a second flow passage) through which the black pigment ink flows while the other waste ink intake 40*b* (a first intake on the right in FIGS. 3A and 3B) is connected to the tube 34 (a first flow passage) through which the three color dye inks flow, wherein all those inks were discharged in suction purge or flushing.

The absorber 41 formed of a porous member into a rectangular parallelepiped is accommodated in the waste ink case 40. As described hereinabove, the waste ink case 40 is provided with the two waste ink intakes 40*a* and 40*b*. The black waste ink flowing in from the waste ink intake 40*a* flows downward along the inner lateral surface of the waste ink case 40 to be absorbed into a corner portion 41*a* (a second end portion) of the absorber 41 on the lower side near the waste ink intake 40*a*. On the other hand, the color waste inks flowing in from the waste ink intake 40*b* flow downward along the inner lateral surface of the waste ink case 40 to be absorbed into another corner portion 41*b* (a first end portion) of the absorber 41 on the lower side near the waste ink intake 40*b*. Thereby, as shown by the dashed lines in FIG. 3A, the black and color waste inks flowing in respectively from the two waste ink intakes 40*a* and 40*b* permeate upward in a radial fashion from the corner portions 41*a* and 41*b* as the centers inside the absorber 41.

Further, since the nozzles 16 discharging the three color inks are three times (with three nozzle rows) as many as the nozzles 16 discharging the black ink, as long as the number of purging or flushing operations is not conspicuously large with respect to the nozzles 16 jetting a specific ink, the color waste inks flowing into the waste ink case 40 are approximately three times as much as the black waste ink. Therefore, as shown by the radial dashed lines in FIG. 3A, as a certain period has elapsed since the waste inks began to flow into the absorber 41, it is predictable that compared with the black waste ink, the color waste inks permeate over a considerable wider range in the absorber 41.

The four-color inks utilized in the embodiment are conductive liquids each having a predetermined electric conductivity. Then, the waste ink detection sensor 42 for detecting the full liquid permeation state of the absorber 41 detects whether or not any waste ink has reached the detection position A by measuring the conductivity at the detection position A of the absorber 41 away from the two waste ink intakes 40*a* and 40*b* by respective predetermined distances.

Next, a principle will be explained for the waste ink detection sensor 42 to detect the waste ink. The waste ink detection sensor 42 has a pair of electrodes arranged at a predetermined detection position on two lateral surfaces 41*c* and 41*d* of the absorber 41 facing each other, respectively, to measure the current value when a predetermined voltage is applied between the pair of electrodes, thereby obtaining the conductivity (the reciprocal of resistivity) at the detection position. In the state of the ink jet printer 1 with its power on, the waste ink detection sensor 42 may measure the current value between the pair of electrodes either constantly or at predetermined time intervals. Further, the waste ink detection sensor 42 may as well measure the current value between the pair of electrodes when the user has inputted an instruction of detecting the full liquid permeation state to the ink jet printer 1.

Further, in the embodiment as shown in FIG. 3A, because the waste ink flowing in from the waste ink intake 40*a* (40*b*) on one side permeates in a radial fashion from the corner portion 41*a* (41*b*) in the lower end of the absorber 41, the upper end of the absorber 41 is inferred to be the last part reached by the waste ink. Therefore, in order for the waste ink detection sensor 42 to detect the full liquid permeation state of the absorber 41, the electrodes are arranged at the detection position A the upper end of the absorber 41.

Further, in the embodiment, because the color waste inks are approximately three times as much as the black waste ink and thus permeate over a wider range compared with the black waste ink, the detection position A for detecting the full liquid permeation is arranged nearer to the side of the black waste ink intake 40*a* (the left side in the figure). In more detail, a rectilinear permeation route 43*b* from the corner portion 41*b* of the absorber 41 on the color ink side to the detection position A (the shortest permeation route) is approximately three times as long as another rectilinear permeation route 43*a* from the corner portion 41*a* on the black ink side to the detection position A. By virtue of this, the black and color waste inks are configured to reach the detection position A almost on the same timing.

Further, if the detection position A were set at a position on the upper end surface of the absorber 41, then when the black and color waste inks concurrently reached that detection position A, the absorber 41 would fall into a limit state in which the waste inks were no longer absorbable. However, as shown in FIG. 3A, if the detection position A is set at a position a little lower than the upper end surface of the absorber 41, then as the waste inks have reached the detection position A, the absorber 41 is still capable of absorbing a little more waste inks. That is, by locating the detection position A at the position shown in FIG. 3A, it is possible to detect a state a little prior to the aforementioned limit state.

However, as described hereinabove, since the detection position A for the waste ink detection sensor 42 (the full liquid detection position) is set at a position according to the assumed quantitative ratio (1:3) of the black waste ink versus the color waste inks, in design (theory), the black and color waste inks should almost concurrently reach the detection position A. In reality, however, the quantity and frequency of the jetted waste ink are not necessarily completely equal for each of the nozzles 16 jetting the four-color inks respectively at a time in suction purge or flushing. Hence, it is easy to imagine that the actual quantities of the black and color waste inks may deviate from the theoretical ratio 1:3. In this case, the black and color waste inks reach the detection position A on different timings. Therefore, if the absorber 41 were determined to be fully permeated as soon as some waste ink was detected to have reached the detection position A, then the full liquid state could be falsely determined because only one part of the waste inks has actually reached the detection position A, while there is still room for absorbing the waste ink(s) on the permeation route 43*a* (43*b*) of the other part of the waste inks. That is, it decreases the efficiency of the absorber 41 in absorbing the waste inks.

Therefore, in the embodiment, the waste ink detection sensor 42 is capable of distinguishing whether only one part or both parts of the black and color inks reaches or reach the detection position A.

First, electric conductivity differs greatly between the black pigment ink and the three color dye inks (yellow, cyan and magenta). For example, under the condition of 25° C., the conductivity of the black ink is 0.3 μs/cm, while the average conductivity of the three color inks is approximately 4.0 μs/cm. Hence, when some waste ink is detected to have reached the detection position A and, further, from the measuring value of the conductivity of the absorber 41 at the detection position A at that time, it is possible for the waste ink detection sensor 42 to distinguish whether only one part or both parts of the black and color inks has or have arrived.

Figure 4:
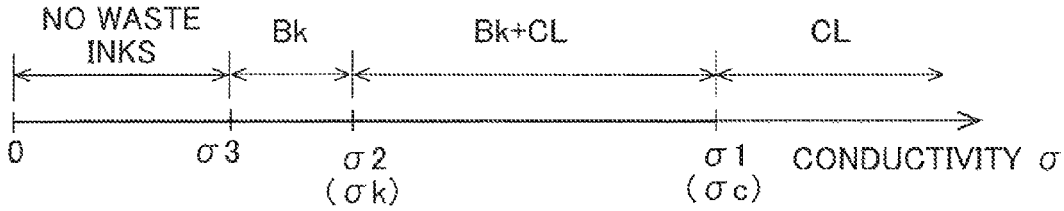
FIG. 4 is a diagram of explaining a threshold value of electric conductivity for determining types of waste inks.

Hereinbelow, more particular explanations will be made with respect to determining types of waste inks by the waste ink detection sensor 42. FIG. 4 is a diagram of explaining a threshold value of electric conductivity for determining types of waste inks. Three threshold values for conductivity ($\sigma 1$, $\sigma 2$ and $\sigma 3$) are preset as $\sigma k$ represents the conductivity of the black ink (0.3 μs/cm, for example), while ac represents the conductivity of the color inks (4.0 μs/cm, for example). The first threshold value $\sigma 1$ and the second threshold value $\sigma 2$ are set to be equal in value to the conductivity $\sigma c$ of the color inks and the conductivity $\sigma k$ of the black ink, respectively. Further, the third threshold value $\sigma 3$ is set to be considerably lower in value than the second threshold value $\sigma 2$ (the conductivity $\sigma k$ of the black ink), close to zero.

Then, if the measuring value $\sigma$ of conductivity at the detection position A is higher than or equal to the first threshold value $\sigma 1$, then the waste ink detection sensor 42 judges that only the color waste inks of high conductivity (CL) have reached the detection position A. On the other hand, if the measuring value $\sigma$ of conductivity is higher than or equal to the third threshold value $\sigma 3$ and lower than or equal to the second threshold value $\sigma 2$, then the waste ink detection sensor 42 judges that only the black waste ink of low conductivity (Bk) has reached the detection position A. Further, if the measuring value $\sigma$ of conductivity is lower than the third threshold value $\sigma 3$ (close to zero), then it determines neither of the waste inks to have reached the detection position A.

On the other hand, if the measuring value $\sigma$ of conductivity is higher than the second threshold value $\sigma 2$ and lower than the first threshold value $\sigma 1$, then because it is a value between the conductivity $\sigma k$ of the black ink and the conductivity $\sigma c$ of the color inks, the waste ink detection sensor 42 judges that both of the black and color waste inks have reached the detection position A in a mixed state.

Further, as shown in FIG. 3A, in addition to the aforementioned waste ink detection sensor 42 for detecting arrival of waste inks at the detection position A, the waste ink recovery device 7 further has two waste ink detection sensors 44 and 45 (second waste liquid detection sections) for detecting whether or not any waste ink has reached detection positions B and C (second detection positions), respectively, between the detection position A and the two waste ink intakes 40*a* and 40*b* of the waste ink case 40. These two waste ink detection sensors 44 and 45 have the same configuration as the aforementioned waste ink detection sensor 42, and serve to detect arrivals of waste inks by measuring the conductivities at the detection positions B and C, respectively.

The detection position B for the waste ink detection sensor 44 is on the rectilinear permeation route 43*a* connecting the detection position A with the corner portion 41*a* of the absorber 41 at which the black waste ink flowing in from the waste ink intake 40*a* starts to permeate initially. Further, the detection position C for the waste ink detection sensor 45 is on the rectilinear permeation route 43*b* connecting the detection position A with the corner portion 41*b* of the absorber 41 at which the color waste inks flowing in from the waste ink intake 40*b* start to permeate initially. Then, by means of the two waste ink detection sensors 44 and 45, it is possible to detect whether or not waste inks have also reached the intermediate detection positions B and C located between the detection position A for detecting the full liquid permeation and the waste ink intakes 40*a* and 40*b*, respectively.

Next, referring to the block diagram of FIG. 5, detailed explanations will be made with respect to a control system of the ink jet printer 1 centered on the controller 8. As shown in FIG. 5, the controller 8 of the ink jet printer 1 is a microcomputer including such as a CPU (Central Processing Unit), a ROM (Read Only Memory) for storing various programs, data and the like to control the overall operation of the ink jet printer 1, a RAM (Random Access Memory) for temporarily storing data and the like to be processed by the CPU, and the like. The controller 8 carries out various controls as will be explained hereinbelow by letting the CPU execute the programs stored in the ROM. Alternatively, the controller 8 may as well be a hardware-like device combining various circuits including an arithmetic circuit.

The controller 8 has a print control section 60 including a head control section 61 for controlling the ink jet head 4, a carriage control section 62 for controlling the carriage drive motor 15 to drive the carriage 3 in the scanning direction, and a transport control section 63 for controlling the transport mechanism 5. The print control section 60 controls the ink jet head 4, the carriage drive motor 15 and the transport mechanism 5, respectively, to carry out printing on the recording paper P, based on a data (a print data) of images and the like inputted from a PC 70 for printing.

Further, the controller 8 includes a maintenance control section 65 for controlling a series of maintenance operations including the aforementioned suction purge by controlling the suction pump 23, the cap drive motor 35 for moving the cap member 21 up and down, and the like in the maintenance unit 6, and a flushing control section 66 for controlling the flushing of the ink jet head 4. Further, the controller 8 includes a full liquid judging section 67 for judging whether or not the absorber 41 of the waste ink recovery device 7 is fully permeated.

Further, the respective functions of the print control section 60, the maintenance control section 65, the flushing control section 66 and the full liquid judging section 67 are, in practice, realized by either the operation of the aforementioned microcomputer or the operations of the various circuits including the arithmetic circuit.

Next, the full liquid judging section 67 will be explained in detail. The full liquid judging section 67 judges whether or not the absorber 41 of the waste ink recovery device 7 is fully permeated based on the detection result from the waste ink detection sensor 42. As described hereinbefore, the waste ink detection sensor 42 can detect it by distinguishing whether only one or both of the black and color waste inks has or have reached the detection position A from the conductivity of the absorber 41 at the detection position A. Thus, if only one of the two types of inks has reached the detection position A while the other part has not, then it is conceivable that the absorber 41 still has room for absorbing more inks (ink-unabsorbed portion).

Here, the full liquid judging section 67 does not judge that the absorber 41 is fully permeated if the waste ink detection sensor 42 detects that only one of the inks has reached the detection position A of the absorber 41, but judges that the absorber 41 is fully permeated if the waste ink detection sensor 42 detects that both of the inks have reached the detection position A of the absorber 41. By virtue of this, if a full liquid state is determined, then since there are almost no ink-unabsorbed portions in the absorber 41 between the detection position A and the waste ink intakes 40*a* and 40*b*, it is possible to accurately judge that the absorber 41 is fully permeated, thereby improving the efficiency of absorbing the waste inks.

Further, in the embodiment, by virtue of the two waste ink detection sensors 44 and 45, it is possible to detect whether or not any inks have reached the intermediate detection positions B and C, too, between the detection position A and the two waste ink intakes 40*a* and 40*b*. Thus, the accuracy of detecting full liquid permeation is improved by letting the full liquid judging section 67 utilize also the detection results from the two waste ink detection sensors 44 and 45 to determine the full liquid permeation state.

For example, when the absorber 41 made of a porous member is rendered an uneven pore density to bring in some local areas where absorbing waste inks is more difficult than the surrounding, if the waste inks flowing in from the waste ink intakes 40*a* and 40*b* bypass the rectilinear permeation routes 43*a* and 43*b* and reach the detection position A, then even though there are still ink-unabsorbed portions on part of the permeation routes 43*a* and 43*b*, the absorber 41 will be determined to be fully permeated. Such kind of abnormal permeation state is prehensible by detecting arrivals of waste inks also at the intermediate detection positions B and C in addition to the detection position A. That is, even when the waste ink detection sensor 42 detects that both of the waste inks have reached the detection position A, if the waste ink detection sensors 44 and 45 detect that the waste inks have not reached at least one of the intermediate detection positions B and C, then the full liquid judging section 67 can still judge that the absorber 41 is not fully permeated.

Further, when one of the waste inks is detected to have reached the detection position A, it is prehensible how close the other part of the waste inks is to the detection position A. Further, if one of the waste inks first reaching the detection position A permeates too far as beyond the detection position A over to the permeation route 43*a* (43*b*) of the other of the waste ink, then the absorber 41 may become completely fully permeated before the other part of the waste inks reaches the detection position A and undesirably, the waste inks may overflow from the waste ink case 40. However, by detecting whether or not the waste inks have reached the intermediate detection position B (the detection position C) on the permeation route 43*a* (43*b*) of the other part, it is possible to sense the above problem in advance. That is, even when the waste ink detection sensor 42 detects only one part of the waste inks to have reached the detection position A, if the waste ink detection sensor 44 (45) detects that one of the waste inks to have reached as far as the detection position B (the detection position C) on the permeation route 43*a* (43*b*) of the other part of the waste inks, then the full liquid judging section 67 can still judge the absorber 41 is fully permeated.

Further, when determining the absorber 41 to be fully permeated, the full liquid judging section 67 sends a detection signal of full liquid permeation to the PC 70 connected to the ink jet printer 1 to inform the user that it is time to exchange the absorber 41 of the waste ink recovery device 7. Further, as described hereinbefore, if the detection position A is set at a position a little lower than the upper end of the absorber 41 as shown in FIG. 3A such that after some waste ink reaches the detection position A, the absorber 41 can still absorb a little more waste inks, then even though the user is unaware of the information of the full liquid permeation state and keeps utilizing the ink jet printer 1 for a while without exchanging the absorber 41, it is still possible to prevent overflow of the waste inks from the waste ink case 40.

Alternatively, when the full liquid judging section 67 judges that the absorber 41 is fully permeated, the ink jet printer 1 may as well be prohibited from operations producing waste inks such as ink jetting of the ink jet head 4, suction purge and the like until the user exchanges the absorber 41.

Next, explanations will be made with respect to modifications applying diverse changes to the embodiment described hereinabove. However, components similar in configuration to those in the embodiment are designated by the same reference numerals, any explanation of which will be omitted as appropriate.

1) In the above embodiment, the two waste ink detection sensors 44 and 45 (the second waste liquid detection sections) are provided to detect whether or not any waste ink has reached the detection positions B and C, respectively, between the detection position A for detecting full liquid permeation and the two waste ink intakes 40*a* and 40*b* of the waste ink case 40. However, even if one or both of these waste ink detection sensors 44 and 45 is or are omitted, it is still possible to detect the full liquid permeation state with the waste ink detection sensor 42 (the waste liquid detection section) alone.

2) In the above embodiment, the detection position A is set at a position leaning to the black waste ink intake 40*a*. However, this detection position A can be appropriately changed according to: the assumed quantitative ratio between the black and color waste inks. For example, if the black and color waste inks are assumed to be almost equal in quantity, then, as shown in FIG. 6, the detection position A is set at a position almost equidistant from the two waste ink intakes 40*a* and 40*b*.

Figure 6:
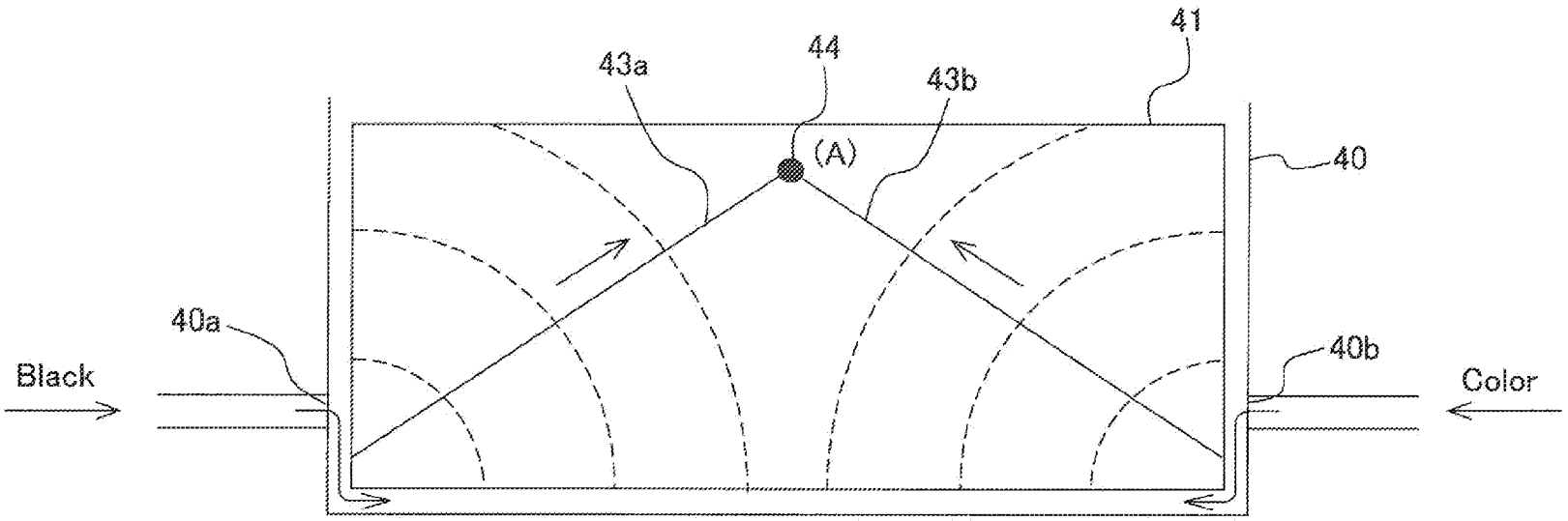
FIG. 6 is a schematic configuration diagram of a waste ink recovery device according to a modification.

Further, even when it is not possible to assume the quantitative ratio between the black and color waste inks, the detection position A may still be set at a position almost equidistant from the two waste ink intakes 40*a* and 40*b* as shown in FIG. 6. However, in this case, because it is sufficiently conceivable that one part of the waste inks first reaching the detection position A permeates beyond the detection position A over to the permeation route 43*a* (43*b*) of the other part, it is preferable to be able to detect, as in the above embodiment, what position the one part of the waste inks has reached on the permeation route 43*a* (43*b*) of the other part up to the detection position A.

Figure 7:
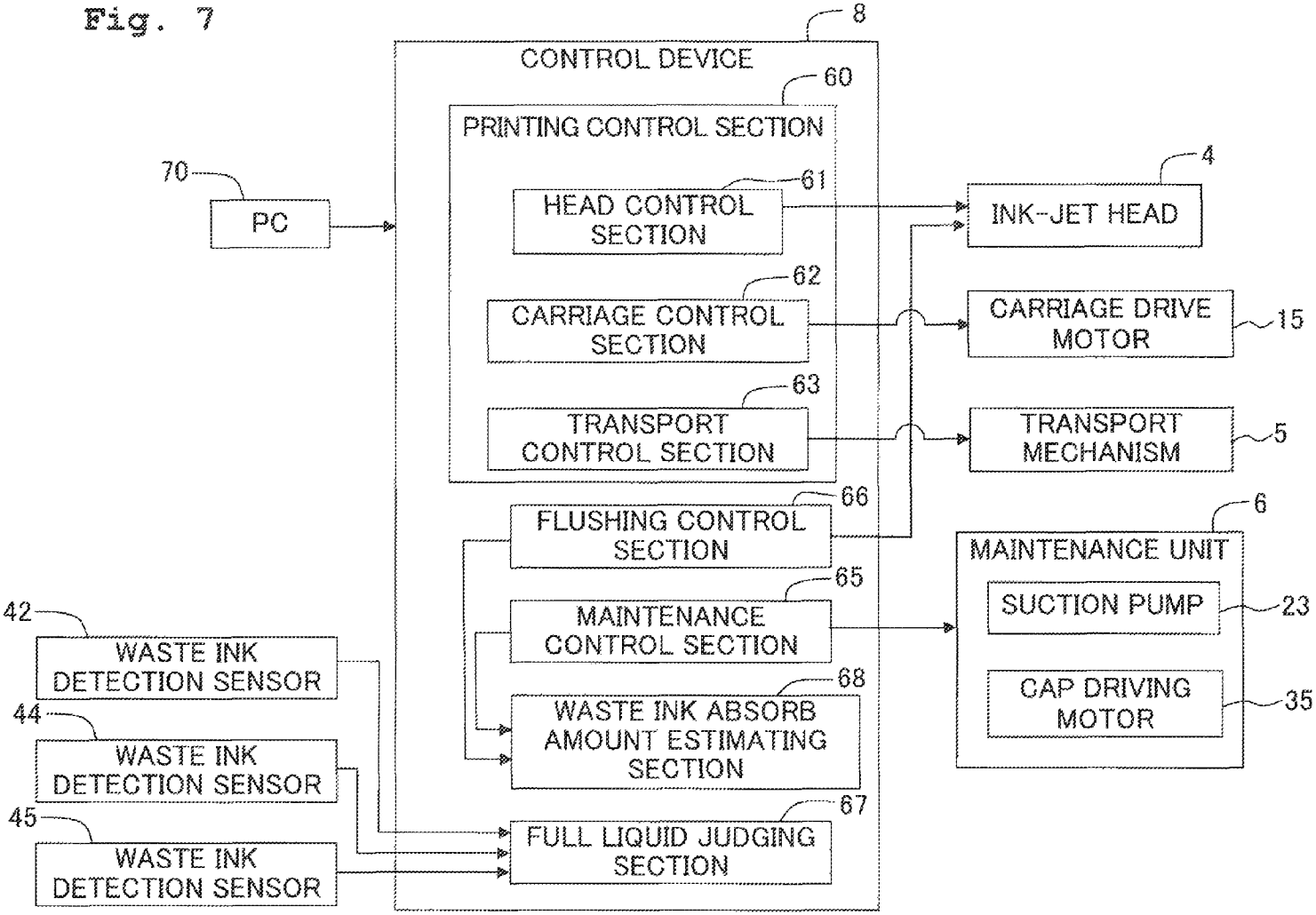
FIG. 7 is a block diagram of an ink jet printer according to another modification.

3) If some problem and the like arise to prevent the waste ink detection sensor 42 from detecting whether or not any ink has reached the detection position A, then the indeterminable state of full liquid permeation may undesirably cause the waste inks to overflow from the waste ink case 40. Therefore, as shown in the block diagram of FIG. 7, the controller 8 may as well be configured to have an absorbed waste ink estimator 68 (an waste liquid absorb amount estimating section) for estimating the amount of waste inks discharged from the ink jet head 4 and absorbed into the absorber 41 in parallel with detecting the waste inks at the detection position A with the waste ink detection sensor 42.

The absorbed waste ink estimator 68 estimates the total amount of waste inks discharged so far from the ink jet head 4 since the ink jet printer 1 began to be utilized (or since the absorber 41 of the waste ink recovery device 7 was exchanged if it was in the past) and, furthermore, estimates the amount of waste liquid absorbed into the absorber 41 based on that total amount of waste inks. An example of a specific estimation method will be provided hereinbelow.

The waste inks collected into the waste ink recovery device 7 can be divided roughly into those from suction purge and those from flushing on a quantitative basis. Here, the maintenance control section 65 stores a designed estimate value of the waste ink amount discharged from the ink jet head 4 in one suction purge operation, while counting the number (frequency) of suction purge operations. Then, the absorbed waste ink estimator 68 estimates the total amount of the waste inks discharged in suction purge by multiplying the estimate value of the waste ink amount in one suction purge operation by the number of the operations. Further, as a matter of course, when the waste ink amount in one suction purge operation varies with ink types (black and color), or when applying suction purges different in strength (suction power), the maintenance control section 65 counts the number in each case individually after presetting a distinct estimate value of the waste ink amount for each suction purge operation.

Further, the flushing control section 66 stores a designed estimate value of the waste ink amount discharged from one nozzle 16 in one flushing operation, while counting the number (the total number: frequency) of the flushed nozzles 16. Then, the absorbed waste ink estimator 68 estimates the total amount of the waste inks discharged in flushing by multiplying the estimate value of the waste ink amount in one flushing operation by the total number of the flushed nozzles 16.

Further, other than the aforementioned suction purge and flushing, the waste inks are also discharged from the ink jet head 4 such as in exchanging the inks in the ink jet head 4 before the initial use of the ink jet printer 1, etc. Therefore, the absorbed waste ink estimator 68 may also estimate the total amount of the waste inks discharged so far by adding such waste ink amounts discharged at other times as well.

Further, the absorbed waste ink estimator 68 estimates the amount of the waste inks absorbed into the absorber 41 by such as multiplying the total amount of the waste inks estimated in the aforementioned manner by a preset evaporative rate, etc.

On top of that, if the amount of the absorbed waste inks estimated by the absorbed waste ink estimator 68 becomes more than or equal to a predetermined limit amount, then the full liquid judging section 67 determines the absorber 41 to be fully permeated regardless of the detection result from the waste ink detection sensor 42. By virtue of this, even when the waste ink detection sensor 42 cannot detect the full liquid permeation state of the absorber 41, it is still possible to prevent overflow of the waste inks.

Further, since the absorbed waste ink estimator 68 estimates the total amount of the waste inks from the ink jet head 4 absolutely based on a designed estimate value, it is unavoidable that the value of estimating the total amount of the waste inks deviates to a certain extent from the total amount of the waste inks actually discharged from the ink jet head 4. In addition, the evaporative rate for estimating the amount of the waste inks absorbed into the absorber 41 changes with environmental conditions of the surroundings (temperature, humidity and the like) and thus is inconstant either. That is, the absorbed waste ink estimator 68 estimates the amount of the absorbed waste inks without so high a degree of accuracy. Therefore, it is preferable to utilize the detection result from the waste ink detection sensor 42, wherever possible, for determining the full liquid permeation state of the absorber 41.

Then, if the waste ink detection sensor 42 is normal, then it is preferable to set the aforementioned limit amount, which is the threshold value for determining the full liquid permeation state based on the estimated amount of the absorbed waste inks, to be greater in value than the amount of the waste inks absorbed into the absorber 41 (the assumed value in design) as both black and color waste inks have reached the detection position A of the absorber 41, such that the detection result from the waste ink detection sensor 42 may always be prioritized over others.

4) In the aforementioned aspects of FIGS. 3A and 6, because the waste inks flowing into the waste ink case 40 from the two waste ink intakes 40*a* and 40*b* permeate toward the detection position A along the rectilinear permeation routes 43*a* and 43*b*, respectively, it is also conceivable that the waste inks reach the detection position A before being absorbed into other areas than the surroundings of the detection position A, such as the upper left and upper right corner portions of the absorber 41, and the like.

Figure 8:
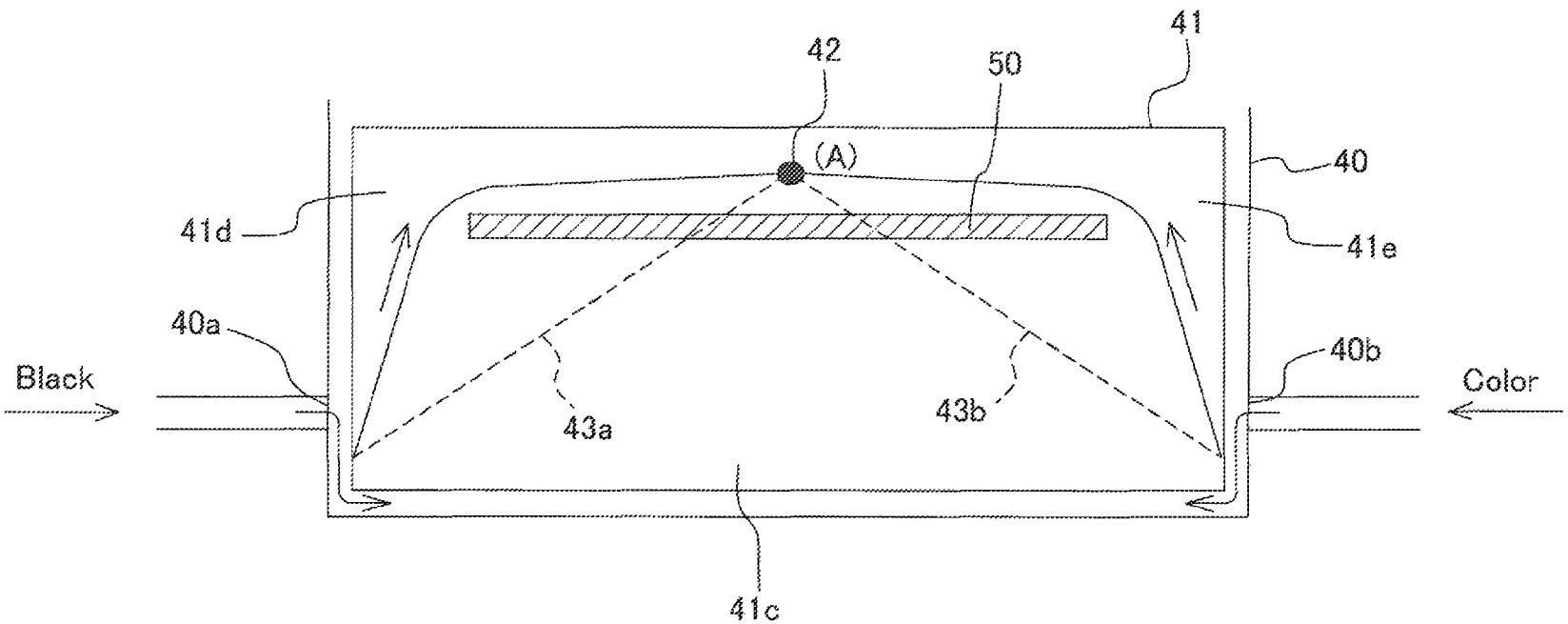
FIG. 8 is a schematic configuration diagram of a waste ink recovery device according to still another modification.

Therefore, as shown in FIG. 8, a partition 50 formed of an ink-impermeable material may as well be provided between the detection position A and the waste ink intakes 40*a* and 40*b* in the waste ink case 40 to intersect the rectilinear permeation routes 43*a* and 43*b* (the dashed lines in the figure) linking both intakes. The partition 50 does not completely partition the absorber 41 into upper and lower portions but, on the left and right sides of the partition 50 in the absorber 41, detour portions (detours) 41*d* and 41*e* are provided to lead the waste inks absorbed by the portion 41*c* below the partition 50 (on the waste ink intakes side) to the detection position A. By virtue of this, the waste inks flowing in from the waste ink intakes 40*a* and 40*b* are prevented from straightly reaching the detection position A. Thus, it becomes possible to make the waste inks reach the detection position A in the last place after the waste inks have been absorbed into almost all other areas than those in the vicinity of the detection position A, thereby improving the efficiency of the absorber 41 in absorption.

5) In the above embodiment, two types of black and color inks flow into the waste ink case 40 from the two waste ink intakes 40*a* and 40*b*, respectively. However, it may as well be configured to let three or more types of inks flow into the waste ink case 40 from different waste ink intakes. In this case, the conductivity range is found through experiments and the like in advance when all liquids have reached the detection position A for detecting the full permeation in the absorber 41 and, if the conductivity measured by the waste ink detection sensor is within the above range found through experiments and the like, then the three or more types of inks have all reached the detection position A. Thereby, a full liquid permeation state can be determined.

Figure 9A:
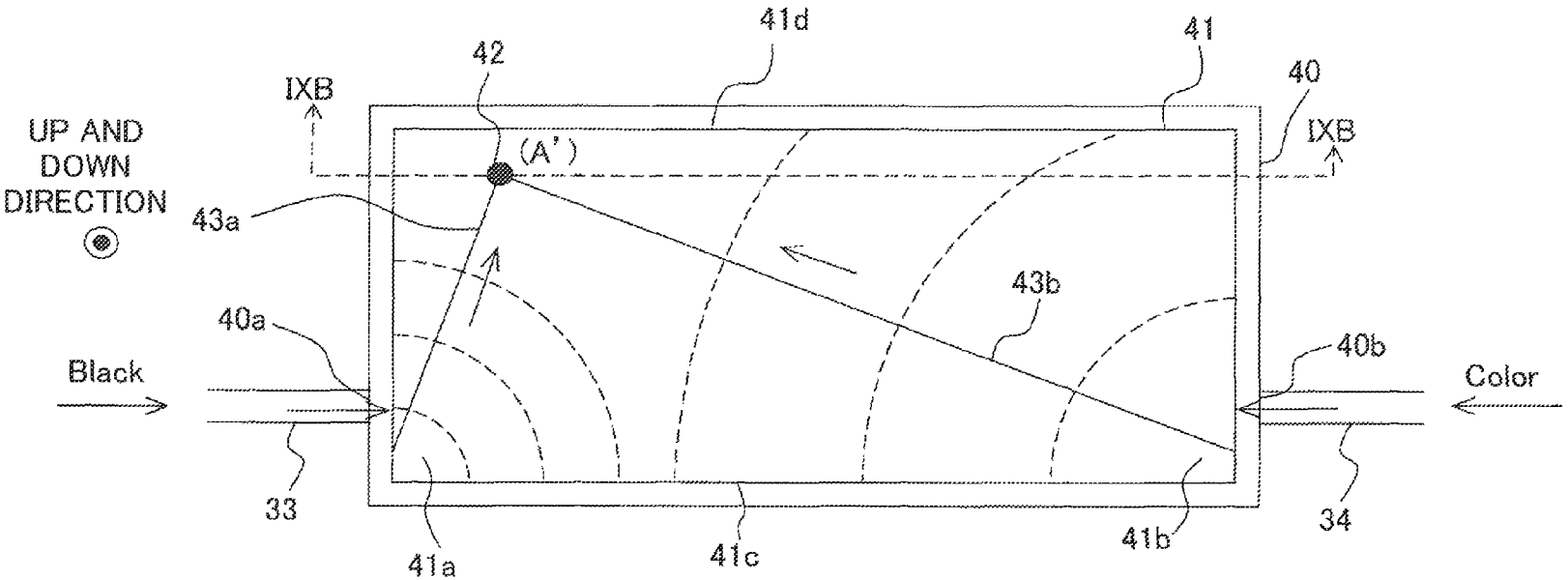
FIG. 9A is a schematic configuration diagram of a waste ink recovery device according to still another modification.
Figure 9B:
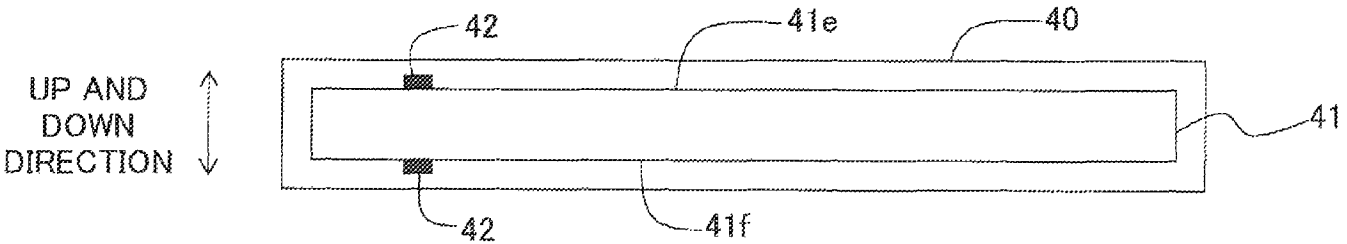
FIG. 9B is a cross-sectional diagram along the line IXB-IXB of FIG. 9A.

In the above embodiment, the electrodes of the waste ink detection sensor 42 are provided on the pair of lateral surfaces 41*c* and 41*d* of the absorber 41 opposite each other. However, the surfaces for arranging the electrodes are not limited to those. As shown in FIGS. 9A and 9B for example, if the waste ink case 40 and the absorber 41 are formed respectively into a thin rectangular parallelepiped in the up and down direction, and the black waste ink intake 40*a* and the color waste ink intake 40*b* are formed respectively in the vicinity of the two corner portions of the waste ink case 40, then the waste inks flowing into the waste ink case 40 from the respective waste ink intakes 40*a* and 40*b* are absorbed into the two corner portions 41*a* and 41*b* of the absorber 41, respectively. Then, as shown in FIG. 9A with the dashed lines, the waste inks permeate respectively in a radial fashion from the corner portions 41*a* and 41*b* as the centers inside the absorber 41. Therefore, the pair of electrodes of the waste ink detection sensor 42 may as well be arranged in a detection position A' on a top surface 41*e* and a bottom surface 41*f* of the absorber 41, respectively.

The embodiment and modifications explained hereinabove are examples of applying the present invention to an ink jet printer for recording images and the like on the recording paper P. However, being not limited to the above examples, the present invention is also applicable to waste liquid recovery devices of other liquid droplet jetting apparatuses for jetting other liquids than inks for recording images.

What is claimed is:

1. A liquid droplet jetting apparatus which jets droplets of two types of liquids different in electric conductivity, the apparatus comprising:

a liquid droplet jetting head which jets the droplets of the two types of liquids, respectively;

a discharge mechanism which discharges the two types of liquids from the liquid droplet jetting head, respectively;

a waste liquid recovery device which recovers the two types of liquids discharged by the discharge mechanism, the waste liquid recovery device including: a waste liquid case, an absorbing body accommodated in the waste liquid case, two liquid intake portions through which the two types of liquids discharged by the discharge mechanism flow respectively into the waste liquid case, and a waste liquid detection section which measures an electric conductivity in the absorbing body at a detection position away from the two liquid intake portions by predetermined distances respectively, and which distinctively detects whether only one of the two types of liquids arrives at the detection position or both of the two types of liquids arrive at the detection position; and a full liquid judging section which judges that the absorbing body is in a full liquid state under a condition that the waste liquid detection section detects that both of the two types of liquids arrive at the detection position in the absorbing body, wherein the two types of liquids are a first liquid, and a second liquid lower in electric conductivity than the first liquid; and the waste liquid detection section judges that the first liquid arrives at the detection position under a condition that the electric conductivity at the detection position in the absorbing body is higher than or equal to a first threshold value, judges that the second liquid arrives at the detection position under a condition that the electric conductivity at the detection position in the absorbing body is lower than or equal to a second threshold value lower than the first threshold value but is higher than or equal to a third threshold value lower than the second threshold value, and judges that both of the two types of liquids arrive at the detection position under a condition that the electric conductivity at the detection position in the absorbing body is lower than the first threshold value but higher than the second threshold value.

2. The liquid droplet jetting apparatus according to claim 1, wherein the waste liquid detection section detects whether only one of the two types of liquids arrives at the detection position or both of the two types of liquids arrive at the detection position based on the electric conductivity in the absorbing body measured by the waste liquid detection section.

3. The liquid droplet jetting apparatus according to claim 1 further comprising a waste liquid absorb amount estimating section which estimates an amount of the waste liquid absorbed in the absorbing body based on a value of a presumed amount of the waste liquid generated by one discharge operation of the discharge mechanism and the number of times of the discharge operations performed by the discharge mechanism, wherein under a condition that the waste liquid amount presumed by the waste liquid absorb amount estimating section is more than or equal to a limit waste liquid amount, the full liquid judging section judges that the absorbing body is in the full liquid, state regardless of the detection result by the waste liquid detection section.

4. The liquid droplet jetting apparatus according to claim 1 further comprising a second waste liquid detection section which measures an electric conductivity in the absorbing body at a second detection position located between the detection position and at least one of the two liquid intake portions, and which detects whether or not at least one of the two types of liquids arrives at the second detection position.

5. The liquid droplet jetting apparatus according to claim 1, wherein the absorbing body has two end portions from which the two types of liquids flowing into the waste liquid case are firstly absorbed, a partition provided between the two end portions and the detection position to prevent the two types of liquids from permeating therethrough, and detour portions which is configured to lead the two types of liquids absorbed into the two end portions around the partition to the side of the detection position respectively.

6. The liquid droplet jetting apparatus according to claim 1, wherein the first liquid is a dye ink and the second liquid is a pigment ink.

7. The liquid droplet jetting apparatus according to claim 1, wherein the two liquid intake portions include a first liquid intake portion through which the first liquid flows into the waste liquid case and a second liquid intake portion through which the second liquid flows into the waste liquid case, and a first flow passage through which the first liquid discharged by the discharge mechanism is led to the first liquid intake portion; and a second flow passage through which the second liquid discharged by the discharge mechanism is led to the second liquid intake portion are formed in the liquid droplet jetting apparatus.

8. The liquid droplet jetting apparatus according to claim 7, wherein the absorbing body accommodated in the waste liquid case has a first end portion from which the first liquid flowing into the waste liquid case from the first liquid intake portion is firstly absorbed, and a second end portion from which the second liquid flowing into the waste liquid case from the second liquid intake portion is firstly absorbed; and a distance from the first end portion to the detection position is longer than a distance from the second end portion to the detection position.

9. The liquid droplet jetting apparatus according to claim 7, wherein the absorbing body accommodated in the waste liquid case has a first end portion from which the first liquid flowing into the waste liquid case from the first liquid intake portion is firstly absorbed, and a second end portion from which the second liquid flowing into the waste liquid case from the second liquid intake portion is firstly absorbed; and a distance from the first end portion to the detection position is substantially equal to a distance from the second end portion to the detection position.

* * * * *